US006309017B1

(12) United States Patent
Middleton

(10) Patent No.: US 6,309,017 B1
(45) Date of Patent: Oct. 30, 2001

(54) REMOVABLE SEAT COVER

(76) Inventor: Greg Middleton, 241 Inglehart Road, Grimsby, Ontario (CA), L3M 4E7

( * ) Notice: Subject to any disclaimer, the term of this patent is extended or adjusted under 35 U.S.C. 154(b) by 0 days.

(21) Appl. No.: 09/663,794

(22) Filed: Sep. 18, 2000

(51) Int. Cl.[7] ..... A47C 31/00
(52) U.S. Cl. ..... 297/219.1; 297/228.13
(58) Field of Search ..... 297/223, 219.1, 297/228.13, 228.1, 229, 188.01

(56) References Cited

U.S. PATENT DOCUMENTS

| | | | |
|---|---|---|---|
| 1,836,302 | | 12/1931 | Bloomfield . |
| 1,878,045 | | 9/1932 | Wedler . |
| 2,179,805 | | 11/1939 | Trubitz . |
| 2,546,109 | | 3/1951 | Puchalsky . |
| 2,771,939 | | 11/1956 | Trubitt . |
| 3,916,447 | * | 11/1975 | Thompson . |
| 4,718,721 | | 1/1988 | Pompa . |
| 4,752,971 | | 6/1988 | Meserol . |
| 4,884,839 | * | 12/1989 | Keiswetter . |
| 4,886,697 | | 12/1989 | Perdelwitz, Jr. et al. . |
| 5,234,252 | | 8/1993 | Wallach . |
| 5,509,718 | * | 4/1996 | Neary . |
| 5,617,904 | | 4/1997 | Kalin . |
| 5,618,082 | | 4/1997 | Jachmich . |
| 5,681,090 | * | 10/1997 | St. Thomas . |
| 5,690,380 | * | 11/1997 | Waters . |
| 5,803,539 | | 9/1998 | Dewar et al. . |
| 5,806,925 | * | 9/1998 | Hanley . |
| 5,843,556 | | 12/1998 | Levas . |
| 6,058,535 | * | 5/2000 | Firkins, Jr. et al. . |
| 6,089,659 | * | 7/2000 | Toyota . |

* cited by examiner

*Primary Examiner*—Milton Nelson, Jr.
(74) *Attorney, Agent, or Firm*—Ingrid E. Schmidt

(57) ABSTRACT

A removable seat cover is provided for use on a seat that forms a substantial liquid barrier. The seat cover has an absorbent body for covering the seat and a water resistant membrane that is releasbly attached to the body. When the membrane is attached to the body and the cover is placed over the seat with the membrane adjacent the seat, the cover forms a substantial liquid barrier.

11 Claims, 3 Drawing Sheets

REMOVABLE SEAT COVER

FIELD OF THE INVENTION

This invention relates to removable seat covers, and more particularly to a removable seat cover that forms a substantial liquid barrier.

BACKGROUND OF THE INVENTION

Seat covers are generally used to protect seats from liquid, dirt or marking. Seat covers may also be used in order to change the appearance of a chair or seat. Seat covers can be manufactured to cover the whole of a seat or to cover parts or portions of a seat.

Seat covers, also referred to as slip covers, are known to cover articles of furniture such as chairs and sofas. These seat covers may have several panels or flaps that can be used to cover the seat portion and the back rest portion of the article of furniture and to fold around the arms or the base of the article of furniture. The seat covers are generally secured to the article of furniture by means which can include either straps that tie up around the back or underneath the article of furniture or using fasteners that are attached to the sides or underneath the furniture. The seat covers must be unfastened before being removed from the article of furniture.

Seat covers are also known to cover automobile seats. These automobile seat covers may be secured to the automobile seat using ties that connect underneath the seat portion of the seat. This securement means can make it awkward for a user to easily and quickly remove the seat cover when desired. These automobile seat covers may protect a vehicle seat from dirt and marking but may not protect the seat from liquid such as water from a person is involved in water sports and who may need to be seated in the vehicle while still wet.

It is therefore desirable to provide a removable seat cover. It is further desirable to provide a removable seat cover that forms a substantial liquid barrier and that can be easily removed and attached to the seat.

SUMMARY OF THE INVENTION

In a broad aspect, the invention provides a removable seat cover for use on a seat to form a substantial liquid barrier. The seat cover has an absorbent body for covering the seat and a water resistant membrane that is releasably attached to the body for maintaining a barrier between the body and the seat. When the membrane is releasably attached to the body and the seat cover is placed over the seat with the membrane adjacent the seat, the seat cover forms a substantial liquid barrier.

In a preferred embodiment of the invention, the seat cover also has a sheet that is coupled to the body and thereby defines a pocket for receiving the water resistant membrane.

BRIEF DESCRIPTION OF THE DRAWINGS

The invention is better understood in reference to the attached description and to the following Figures, wherein.

DETAILED DESCRIPTION OF THE INVENTION

Figures 1, 2:
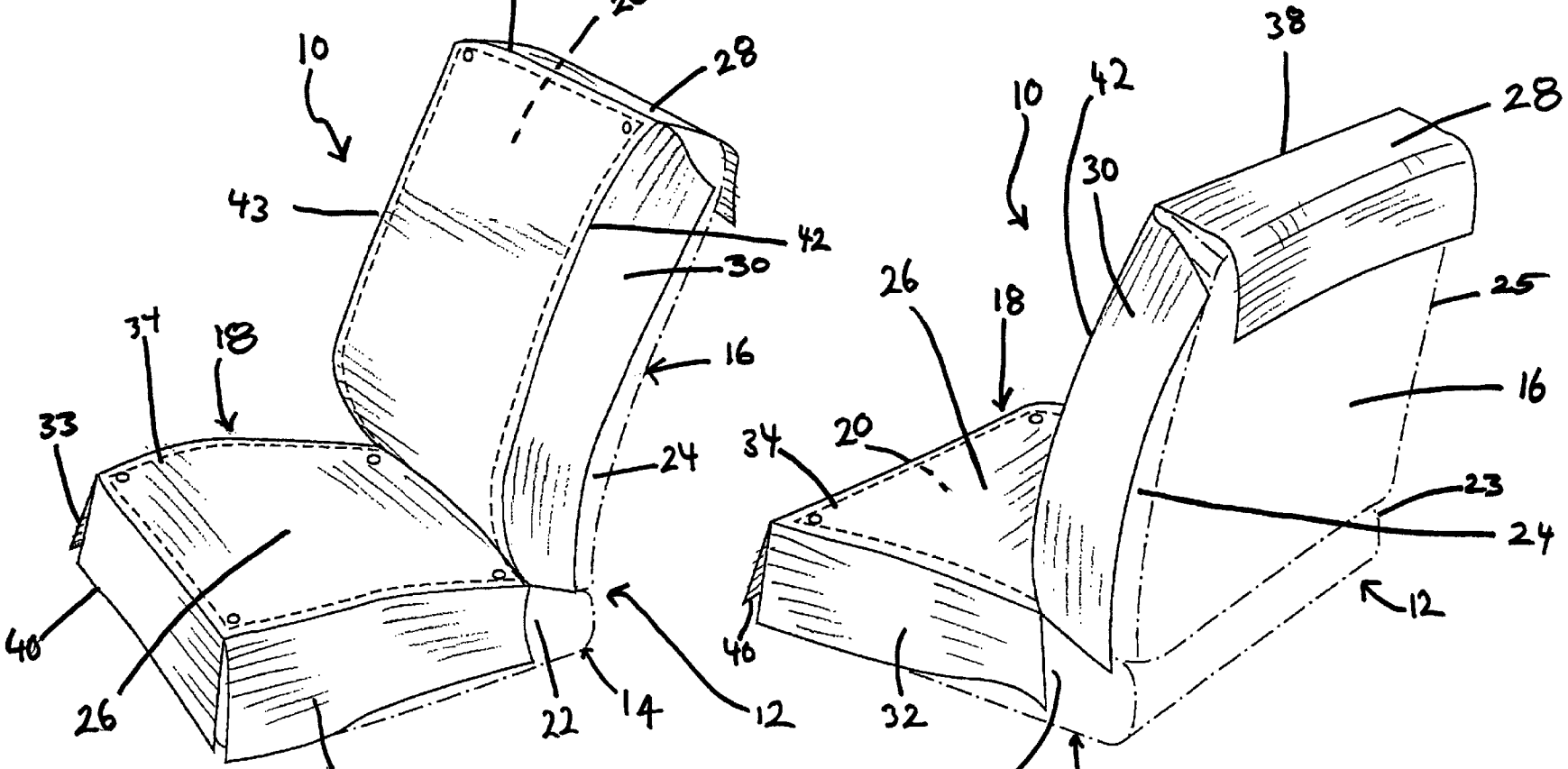
FIG. 1 is an isometric side view of the preferred embodiment of the removable seat cover of the present invention, positioned on a seat shown in ghost outline with a membrane shown in hidden detail.
FIG. 2 is an isometric side view of the seat cover of FIG. 1, viewed from the back of a seat which is shown in ghost outline.
Figure 3:
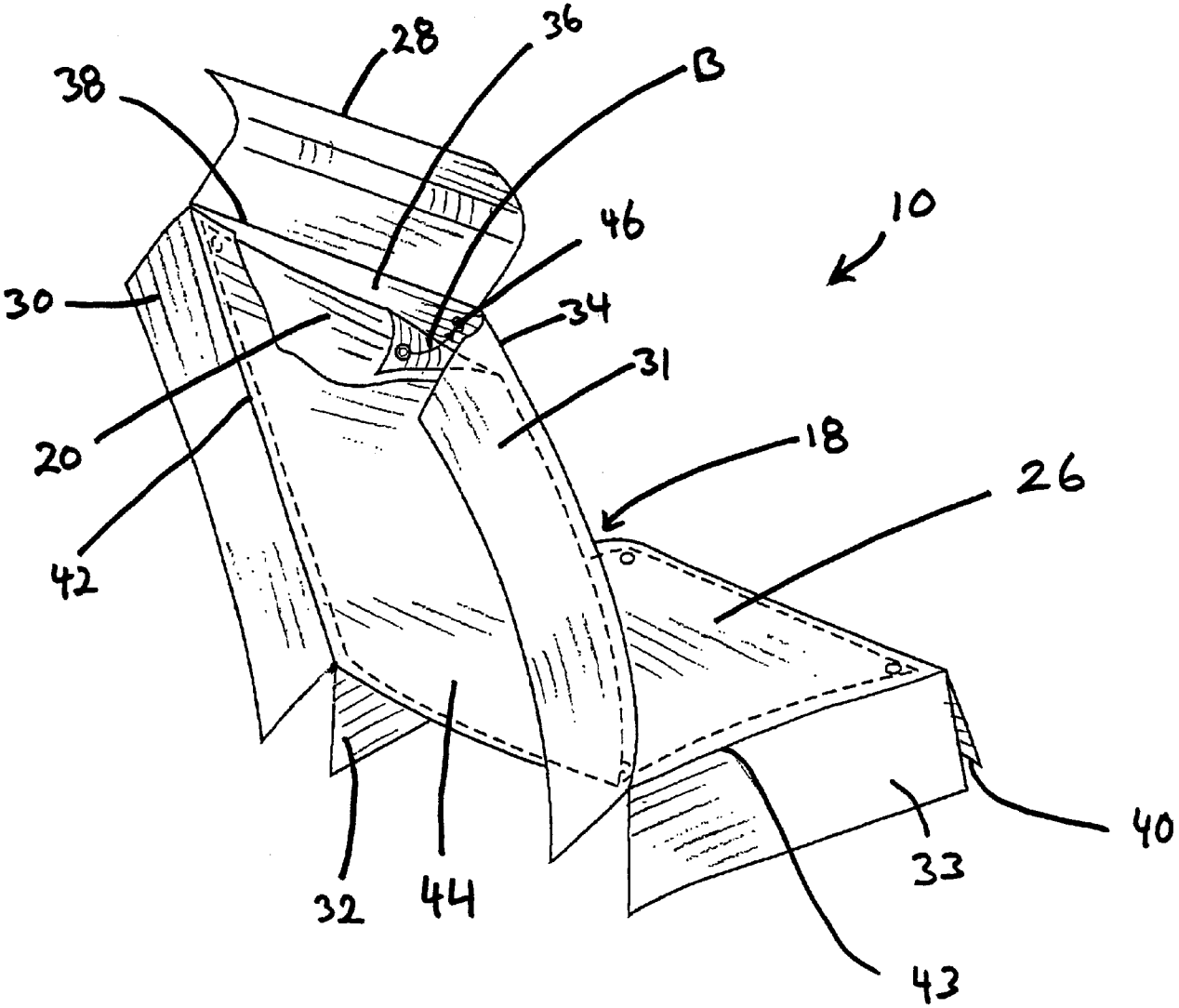
FIG. 3 is an isometric view of the seat cover of FIG. 1, removed from the seat and viewed from the back, showing a sheet that defines a pocket located on the back of the seat cover with a portion broken away to illustrate a membrane located within the pocket.

Reference is first made to FIGS. 1 to 3 to describe a preferred embodiment of a removable seat cover, in accordance with the invention, designated generally by the numeral 10.

The removable seat cover 10 includes an absorbent elongated body 18 for covering the seat 12 and an elongated water resistant membrane 20 for releasably attaching to the body 18 and for maintaining a barrier between the seat cover 10 and the seat 12. When the membrane 20 is releasably attached to the body 18 and placed on the seat 12 with the membrane 20 adjacent the seat 12, the seat cover 10 forms a substantial liquid barrier.

In order to clearly describe the invention and its use, the removable seat cover 10 is shown adapted for use with a seat 12. The seat 12 has a seat portion 14 and a back rest portion 16. The seat portion 14 is of a width defined by seat portion edges 22, 23. In a similar manner, the back rest portion 16 is of a similar width to the seat portion 14 and is defined by back rest edges 24, 25. The removable seat cover 10 can also be used on a seat that has a head rest portion, not shown.

It will be evident from FIGS. 1 and 2 that body 18 is adapted to fit over the seat 12. The body 18 may have a substantially greater length and width than the seat 12 and can be manufactured to fit varying sizes of seat. The body 18 is made from an absorbent material, such as terry cloth.

Figure 4:
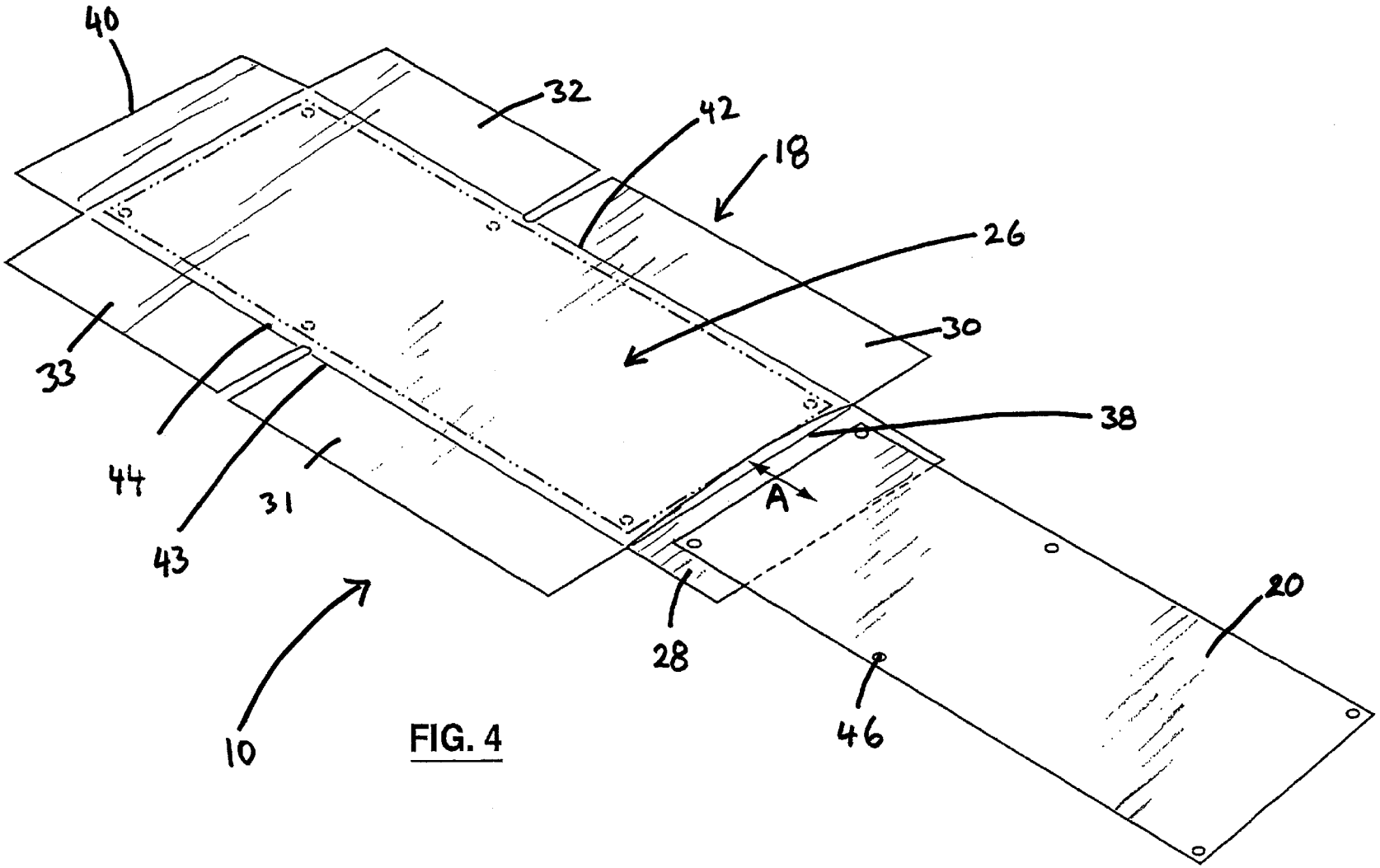
FIG. 4 is an exploded planar view of the seat cover of FIG. 1, with the membrane removed from the pocket of the seat cover.

Referring now to FIG. 4 to further describe the structure of the body 18, the body 18 defines a main panel 26, a head rest panel 28, a pair of laterally extending upper side flaps 30, 31, and apair of laterally extending lower side flaps 32, 33. The main panel 26 has a front side 34, shown in FIGS. 1–3, and a rear side 36 (FIG. 3 ) and is defined by a first end 38 longitudinally spaced from and a second end 40 interconnected by side edges 42, 43. The main panel 26 is of a suitable width to cover the seat portion 14 and the back rest portion 16 and of a suitable length to cover the seat portion 14 and the back rest portion 16 of the seat 12. When in use, the main panel 26 is placed along the seat portion 14 and the back rest portion 16 of the seat 12.

The head rest panel 28 is of a similar width to the main panel 26 and extends from the first end 38 of the main panel 26. In use, the head rest panel 28 can be placed over a head rest portion of a seat, not shown, or over the back rest portion 16 of the seat 12, as shown in FIGS. 1 and 2.

In order to cover the edges of the seat 12, the upper side flaps 30,31 and the lower side flaps 32,33 are operable to fold around the back rest edges 24,25 and the seat portion edges 22,23 respectively. The upper side flaps 30, 31 are located on opposing side edges 42, 43 of the main panel 26, adjacent the head rest panel 28. The upper side flaps 30, 31 are sized to extend along respective back rest edges 24,25 of the back rest portion 16 of the seat 12. The lower side flaps 32, 33 are located along the opposing side edges 42, 43 of the main panel 26, adjacent the upper side flaps 30, 31 at the opposing end of the upper side flaps 30,31 to the head rest panel 28 and sized to extend along respective seat portion edges 22,23 of the seat portion 14 of the seat 12.

Referring now to FIGS. 3 and 4 to describe the structure of the membrane 20, the membrane 20 is substantially rectangular and is adapted to fit on the rear side 36 of the main panel 26. The membrane 20 is made from a suitable water resistant material, preferably a nylon weave. The membrane 20 is releasably attached to the rear side 36 of the main panel 26 using at least one fastener 46 (FIG. 3). Preferably, a series of snap fasteners are located at spaced intervals around the exterior edges of the membrane 20 and around corresponding edges of the main panel 26 to attach the membrane 20 to the main panel 26. In order to hold and position the membrane 20 adjacent the main panel 26, a sheet 44 is stitched to the rear side 36 of the main panel 26. The sheet 44 defines a pocket 48 that is of a suitable size to receive the membrane 20.

Reference will now be made to FIGS. 1 through 4 to describe the use of the removable seat cover 10. Before the seat cover 10 is placed on the seat 12, the membrane 20 is placed in the pocket 48, in the direction indicated by arrow A in FIG. 4. After the membrane 20 has been received in the pocket 48, the membrane 20 can be releasably attached to the rear side 36 of the main panel 26 using the fasteners 46, as shown by arrow B on FIG. 3. The seat cover 10 is now ready to be used, and is placed over the seat 12 with the pocket 48 located adjacent the seat 12. The main panel 26 is adapted to cover the seat portion 14 and the back rest portion 16 of the seat 12. As will be seen in FIGS. 1 and 2, thread rest panel 28 is placed over the back rest portion 16. The second end 40 of the main panel 26 fits over the front end of the seat portion 14 of the seat 12. In order to protect the sides of the seat 12, the upper side flaps 30, 31 are positioned around respective back rest edges 24, 25 and the lower side flaps 32, 33 are positioned around respective seat portion edges 22, 23.

The seat cover 10 can be readily removed from the seat 12 since it is not secured to the seat 12. However, if securement of the seat cover 10 to the seat 12 is required, a series of fasteners, not shown, may be located on the head rest panel 28, the upper side flaps 30,31, and lower side flaps 32,33, on the sides that are located adjacent the seat 12. An example of a suitable fastener would be a VELCRO strip.

The preferred embodiment can be modified in many ways. For instance, the preferred form of the removable seat cover 10 may be made from any absorbent material, and the membrane 20 may be made from any water resistant material. The fasteners 46 can be any fastener that will releasably attach the membrane 20 to the main panel 26, such as snap fasteners, buttons, zip fasteners, or velcro. The seat cover 10 may be manufactured to fit varying sizes of seats. The seat cover 10 can be used without the sheet 44 and with the membrane 20 releasably attached to the main panel 26.

The above-described embodiments of the invention are intended to be examples of the present invention and alterations and modifications may be effected thereto, by those of skill in the art, without departing from the scope of the invention which is defined solely by the claims appended hereto.

I claim:

1. A removable seat cover for use on a seat, the seat including a seat portion of a width defined by seat portion edges, a back rest portion of a similar width to the seat portion and defined by back rest edges, and a head rest portion, the removable seat cover having:

an elongated absorbent body defining a main panel having a front side and a rear side and first and second ends interconnected by side edges, and adapted to locate along the seat portion and the back rest portion of the seat;

a head rest panel located and extending from the first end of the main panel, and adapted to locate over the head rest portion of the seat;

at least a pair of laterally extending upper side flaps located along a portion of respective side edges of the main panel at the first end of the main panel and adapted to locate along and around respective back rest edges of the back rest portion of the seat; and at least a pair of laterally extending lower side flaps located along a portion of respective side edges of the main panel adjacent said upper side flaps, and adapted to locate along and around respective seat portion edges of the seat portion of the seat;

an elongated water resistant membrane releasably coupled to the rear side of the main panel for maintaining a barrier between the main panel and the seat; and a sheet coupled to and adapted to fit along the rear side of the main panel, and defining a pocket for receiving the membrane, whereby when the membrane is located in the pocket and the main panel extends along the seat portion and the back rest portion of the seat, the seat cover forms a substantial liquid barrier.

2. A removable seat cover according to claim 1, wherein the main panel has at least one fastener for coupling the membrane to the main panel.

3. A removable seat cover according to claim 2, wherein the at least one fastener is a snap fastener.

4. A removable seat cover according to claim 1, wherein the body is made from terry cloth.

5. A removable seat cover according to claim 1, wherein the body has at least one fastener for attaching the body to the seat.

6. A removable seat cover, for use on a seat, having:

an absorbent elongated body for covering the seat;

an elongated water resistant membrane releasably coupled to the body for maintaining a barrier between the body and the seat; and a sheet coupled to the body and defining a pocket for receiving the membrane, whereby when the membrane is located in the pocket and the body is placed over the seat with the sheet adjacent the seat, the seat cover forms a substantial liquid barrier.

7. A removable seat cover according to claim 6, wherein the body has at least one fastener for attaching the membrane to the body.

8. A removable seat cover according to claim 7, wherein the at least one fastener is a snap fastener.

9. A removable seat cover according to claim 6, wherein the body is made from terry cloth.

10. A removable seat cover according to claim 6, wherein the body has at least one fastener for attaching the body to the seat.

11. A removable seat cover according to claim 6, wherein the sheet is substantially co-extensive with the body.

* * * * *